US009067313B2

(12) United States Patent
Green et al.

(10) Patent No.: US 9,067,313 B2
(45) **Date of Patent: *Jun. 30, 2015**

(54) HOLE SAW KIT

(71) Applicant: Irwin Industrial Tool Company, Huntersville, NC (US)

(72) Inventors: Matthew C. Green, Amherst, MA (US); Peter Weremchuk, Simsbury, CT (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/177,930

(22) Filed: Feb. 11, 2014

(65) Prior Publication Data

US 2014/0158569 A1 Jun. 12, 2014

Related U.S. Application Data

(63) Continuation of application No. 13/453,604, filed on Apr. 23, 2012, now Pat. No. 8,646,601.

(51) Int. Cl.
*B65D 85/28* (2006.01)
*B25H 3/00* (2006.01)

(52) U.S. Cl.
CPC ..... *B25H 3/003* (2013.01); *B25H 3/006* (2013.01)

(58) Field of Classification Search
USPC ..... 206/349, 372, 373, 493, 379
See application file for complete search history.

(56) References Cited

U.S. PATENT DOCUMENTS

| | | | | |
|---|---|---|---|---|
| 2,459,460 | A * | 1/1949 | Segal | 206/349 |
| 4,199,060 | A | 4/1980 | Howard | |
| 5,918,741 | A | 7/1999 | Vasudeva | |
| 6,119,859 | A | 9/2000 | Wen | |
| D477,714 | S | 7/2003 | Cunningham et al. | |
| D481,868 | S | 11/2003 | Cunningham et al. | |
| 6,868,967 | B2 * | 3/2005 | Lam | 206/350 |
| 6,986,538 | B1 | 1/2006 | Ecker | |
| 7,328,796 | B2 | 2/2008 | Brunson et al. | |
| D563,670 | S | 3/2008 | Cornwell et al. | |
| D578,759 | S | 10/2008 | Grenier et al. | |
| D579,202 | S | 10/2008 | Grenier et al. | |
| 7,552,742 | B2 | 6/2009 | Dole | |
| 7,699,176 | B2 | 4/2010 | Lin | |
| 7,824,137 | B2 | 11/2010 | Vasudeva et al. | |
| D650,173 | S | 12/2011 | Lima et al. | |
| D650,585 | S | 12/2011 | Jamison et al. | |
| 8,443,972 | B1 * | 5/2013 | Pendergraph et al. | 206/349 |
| 8,646,601 | B2 * | 2/2014 | Green et al. | 206/373 |
| 2005/0072701 | A1 | 4/2005 | Allan et al. | |
| 2008/0011634 | A1 | 1/2008 | Lin | |
| 2008/0014035 | A1 | 1/2008 | Perkovich et al. | |

(Continued)

FOREIGN PATENT DOCUMENTS

JP 5-93776 12/1993

*Primary Examiner* — Jacob K Ackun
(74) *Attorney, Agent, or Firm* — McCarter & English, LLP

(57) ABSTRACT

A kit for carrying hole saws has a hole saw carrier configured to releasably carry thereon a plurality of nested hole saws, and is movable between (i) a storage position and (ii) a use position for removing one or more hole saws therefrom. The carrier is axially-elongated and receivable through an arbor hole in a hole saw to releasably carry the hole saw thereon and to allow one hole saw to be nested within another thereon. The carrier is pivotally mounted and movable between the storage and use positions.

19 Claims, 3 Drawing Sheets

(56) References Cited * cited by examiner

U.S. PATENT DOCUMENTS

2008/0078684 A1 4/2008 Lin
2009/0169317 A1 7/2009 Rae

HOLE SAW KIT

CROSS-REFERENCE TO RELATED APPLICATION

This application is a continuation of co-pending U.S. patent application Ser. No. 13/453,604, filed Apr. 23, 2012, which is hereby expressly incorporated by reference in its entirety as part of the present disclosure.

FIELD OF THE INVENTION

The present invention relates to kits and like devices for holding tools, and more particularly, relates to kits and like devices for holding hole saws.

BACKGROUND INFORMATION

Tradesmen, such as plumbers, electricians, and heating, ventilating and air conditioning ("HVAC") technicians, can struggle with the weight and size of tools and supplies they must bring to worksites. This difficulty is exasperated by the desire to bring to worksites all tools and supplies that might possibly be needed to eliminate potentially wasteful time spent on multiple trips back and forth to the worksite to bring in additional tools and supplies. As a result, tradesman may overload their tool bags and boxes with heavy and awkward tools in an effort to bring as many tools and supplies as possible to worksites. Hole saws and hole cutters (collectively referred to herein as "hole saws"), arbors for driving the hole saws, and related tools and accessories, such as pilot drill bits, can be loosely packed into traditional tool kits, bags or boxes, taking up significantly more volume than desired and making it difficult to find the individual holes saws, arbors or other accessories when needed.

It is an object of the present invention to overcome one or more of the above-described drawbacks and/or disadvantages of the prior art.

SUMMARY OF THE INVENTION

In accordance with one aspect, the present invention is directed to device for carrying hole saws comprising a hole saw carrier configured to releasably carry thereon a plurality of nested hole saws, and movable between (i) a storage position and (ii) a use position for removing one or more hole saws therefrom. In some embodiments of the present invention, the carrier is axially-elongated and receivable through an arbor hole in a hole saw to releasably carry the hole saw thereon and to allow one hole saw to be nested within another thereon. In some such embodiments, the axially-elongated carrier is pivotally mounted on the device and pivotable between the storage and use positions.

In some embodiments of the present invention, the carrier is retracted within the device in the storage position, and the carrier extends from the device in the use position to facilitate the release of hole saws therefrom. In some such embodiments, in the use position the carrier is substantially upright.

In some embodiments of the present invention, the device defines a recess that receives at least part of the carrier and any hole saws carried thereon in the storage position. In some such embodiments, the recess defines a plurality of different width recessed portions. Each such portion corresponds to the diameter of a respective size hole saw for receiving at least part of the hole saw of the respective size therein in the storage position. Preferably, the different width recessed portions define progressively more narrow widths relative to each other in an axial direction of the carrier for receiving therein a plurality of nested hole saws in the storage position.

In some embodiments of the present invention, the device includes a base and a cover. The base and/or cover is movable relative to the other between open and closed positions. In the closed position the carrier is in the storage position and is substantially prevented from movement into the use position, and in the open position the carrier is movable between the storage and use positions. In some such embodiments, the base defines a first recess for receiving a first portion of the carrier and/or any hole saws carried thereon in the storage position, and the cover defines a second recess for receiving a second portion of the carrier and/or any hole saws carried thereon in the storage position.

In some embodiments of the present invention, the base and/or cover defines a recess for receiving at least a portion of the carrier and any hole saws carried thereon in the storage position, and (i) at least one hole saw mount located laterally relative to the recess for releasably mounting a hole saw; (ii) at least one arbor mount located laterally relative to the recess for releasably mounting an arbor; and/or (iii) at least one pilot drill mount located laterally relative to the recess for releasably mounting a pilot drill. In some embodiments of the present invention, each mount frictionally engages the respective hole saw, arbor and/or pilot drill to releasably retain it within the device. In some embodiments (i) the at least one hole saw mount is defined by a respective hole saw recess located laterally relative to the first or second recess for releasably receiving at least a portion of at least one hole saw therein; (ii) at least one arbor recess is located laterally relative to the first or second recess for releasably receiving at least a portion of at least one arbor therein; and/or (iii) at least one pilot drill recess is located laterally relative to the first or second recess for releasably receiving at least a portion of at least one pilot drill therein.

In accordance with another aspect, the present invention is directed to a device for carrying hole saws comprising first means for releasably carrying thereon a plurality of nested hole saws; and second means for moving the first means between (i) a storage position, and (ii) a use position for removing one or more hole saws therefrom.

In some embodiments of the present invention, the first means is an axially-elongated carrier receivable through an arbor hole in a hole saw to releasably carry a plurality of nested hole saws, and the second means is a pivot mount located between the carrier and device for pivoting the carrier on the device between the storage and use positions.

One advantage of the present invention is that the device allows tradesmen or other persons to store in a kit or like device a plurality of hole saws, such as a complete or typical set of hole saws, and if desired, associated arbors and/or other accessories, and to conveniently transport such hole saws, and if desired, associated arbors and other accessories, to and from worksites. Another advantage of the present invention is that the carrier allows the hole saws to be carried thereon in a nested arrangement which reduces the volume and/or footprint of the stored hole saws and, in turn, reduces the size of the kit or like device for holding and transporting the hole saws. Yet another advantage of the present invention is that the carrier can be moved between storage and use positions to easily install hole saws thereon for storage, and to remove holes saws therefrom for use. Yet another advantage is that the kit organizes and stores the hole saws in a nested arrangement thereby reducing the volume and footprint of the stored hole saws and facilitating quick and convenient retrieval of hole saws when needed for use.

Other objects and advantages of the present invention, and/or of the currently preferred embodiments thereof, will become more readily apparent in view of the following detailed description of the currently preferred embodiments and accompanying drawings.

DETAILED DESCRIPTION OF CURRENTLY PREFERRED EMBODIMENTS

Figure 1:
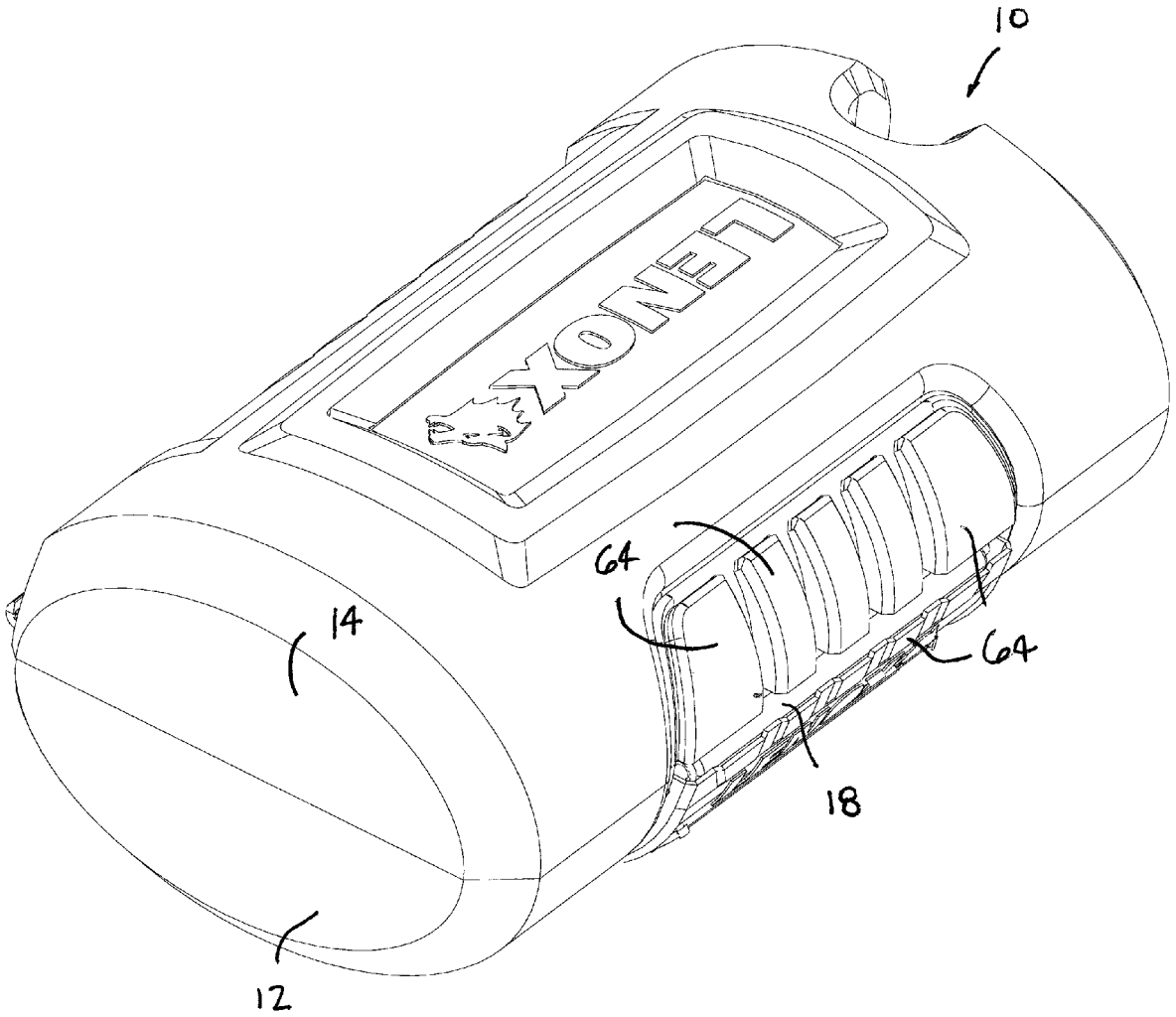
FIG. 1 is a perspective view of a hole saw kit embodying the present invention in the closed position.
Figure 2:
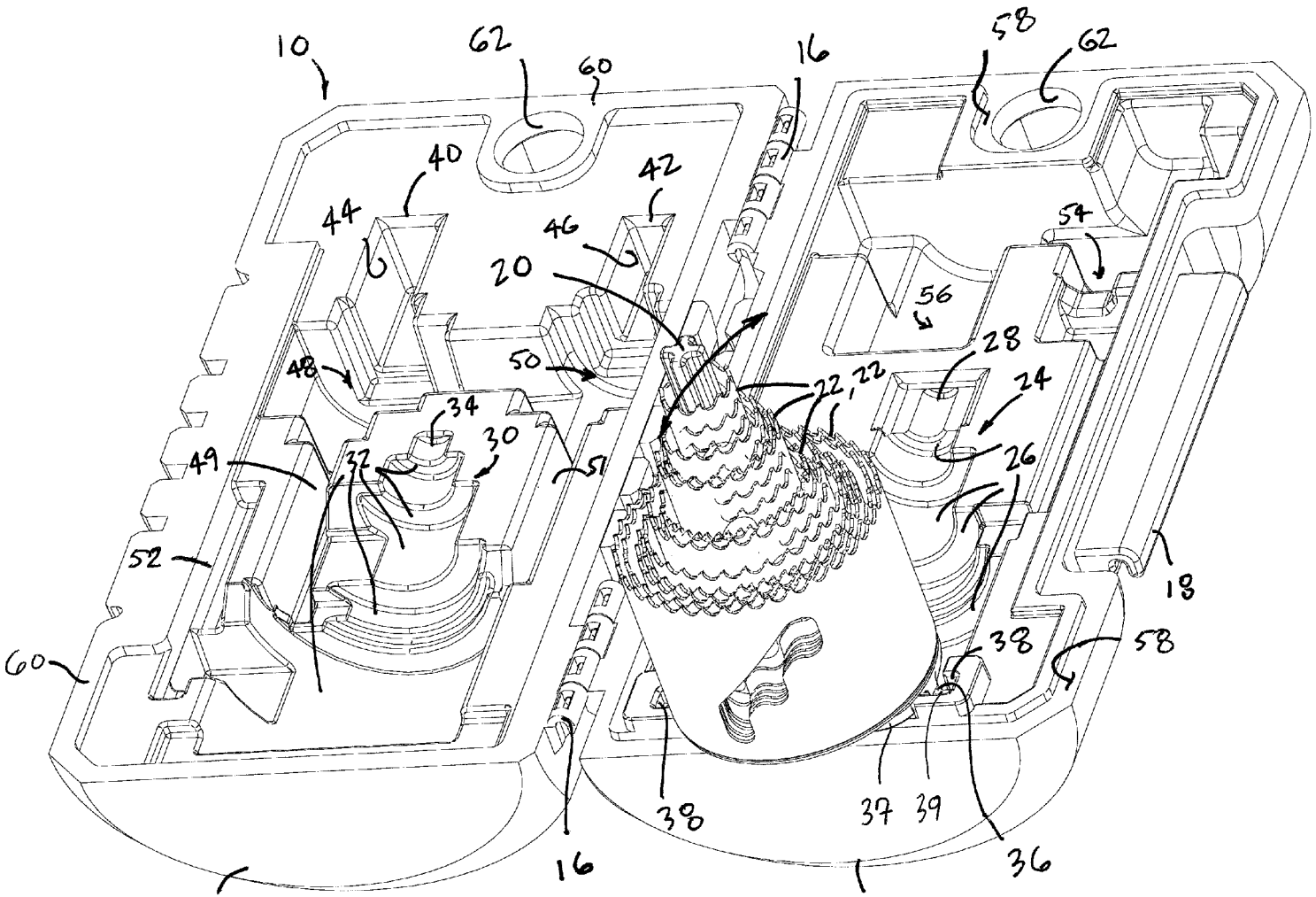
FIG. 2 is a perspective view of the hole saw kit of FIG. 1 in the open position with the carrier in the extended or use position for removing therefrom or installing thereon one or more hole saws.
Figure 3:
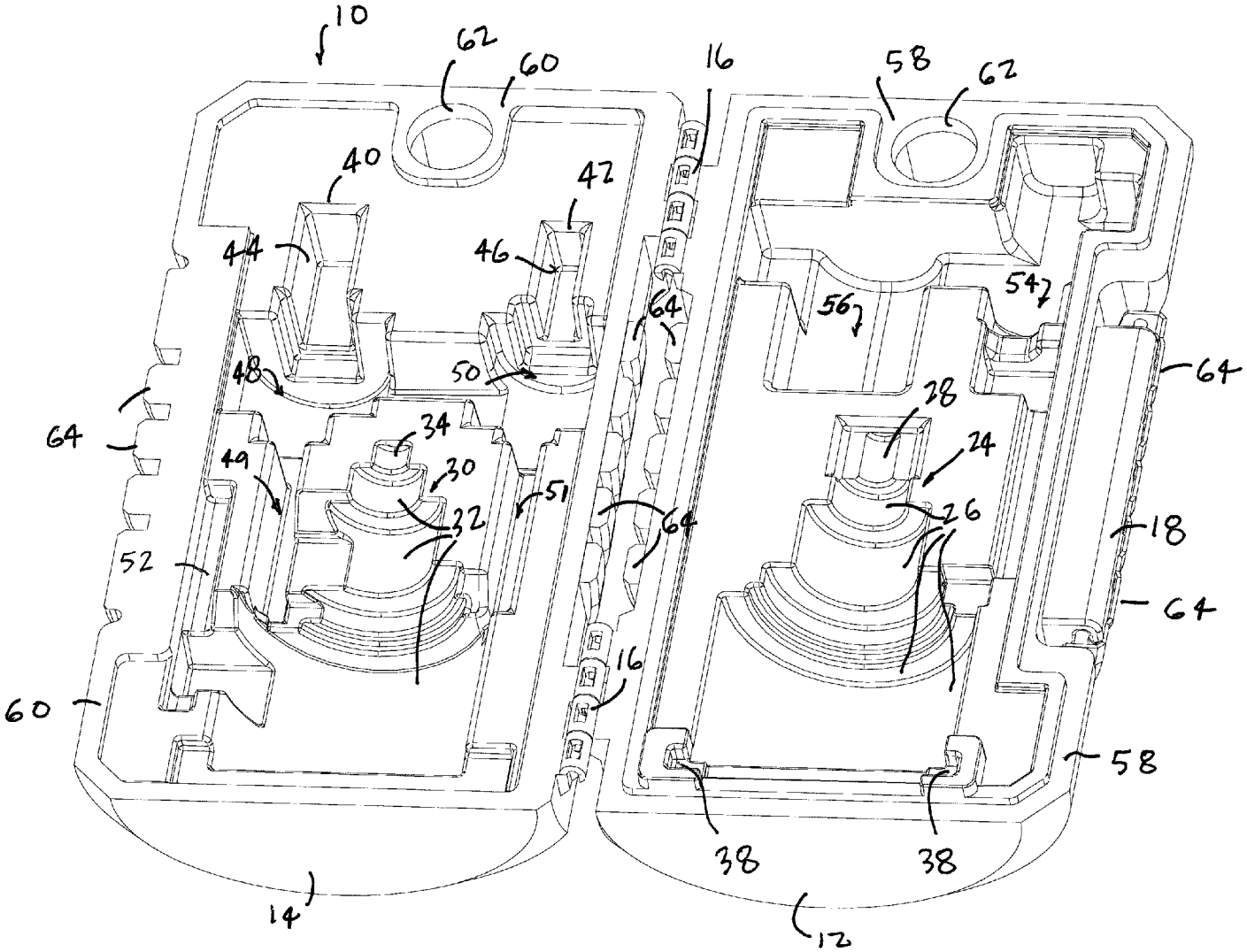
FIG. 3 is a perspective view of the hole saw kit of FIG. 1 in the open position with the carrier and hole saws omitted for clarity.

In FIGS. 1-3, a device embodying the present invention is indicated generally by the reference numeral 10. The device 10 is a kit for storing hole saws, and if desired, for storing arbors for driving the hole saws and other tools or accessories, such as pilot drill bits. The kit 10 includes a base 12 and a cover 14 pivotally mounted to the base by a hinge 16. The base 12 includes a closure 18 of a type known to those of ordinary skill in the pertinent art that releasably engages the cover in the closed position to hold the cover closed, as shown in FIG. 1, but is movable to release the cover from the base and move the cover into the open position, as shown in FIG. 2.

As shown best in FIG. 2, the kit 10 includes a hole saw carrier 20 configured to releasably carry thereon a plurality of nested hole saws 22, 22. As indicated by the arrow in FIG. 2, the carrier 20 is movable between (i) a storage position, and (ii) a use position for removing one or more hole saws therefrom. As can be seen, the carrier 20 is axially-elongated and receivable through an arbor hole (not shown) in each nested hole saw to releasably carry the hole saws thereon and to allow the hole saws to be nested within each other. In the illustrated embodiment, the axially-elongated carrier 20 is pivotally mounted to the base 12 and is pivotable between the storage and use positions. The carrier 20 is retracted within the kit in the storage position, and the carrier extends from the kit in the use position to facilitate the release of hole saws 22, 22 therefrom. As shown in FIG. 2, in the use position, the carrier 20 is substantially upright.

The base 12 defines a first carrier-associated recess 24 that receives part of the carrier and any hole saws carried thereon in the storage position. The first carrier-associated recess 24 defines a plurality of first different width recessed portions 26. Each such portion 26 corresponds to the diameter of a respective size hole saw 22 for receiving at least part of the hole saw of the respective size therein in the storage position. The first different width recessed portions 26 define progressively more narrow widths relative to each in an axial direction of the carrier 20 for receiving therein a plurality of nested hole saws in the storage position. The inner end of the first carrier-associated recess 24 defines a reduced-width portion 28 for receiving the free end of the carrier 20 in the storage position. The cover 14 defines a second carrier-associated recess 30 that receives the opposite sides of the carrier 20 and any hole saws 22, 22 carried thereon in the storage position. The second carrier-associated recess 30 defines a plurality of second different width recessed portions 32. Each such portion 32 corresponds to the diameter of a respective size hole saw 22 for receiving at least part of the hole saw of the respective size therein in the storage position. The second different width recessed portions 32 define progressively more narrow widths relative to each other in an axial direction of the carrier 20 for receiving therein a plurality of nested hole saws in the storage position. The inner end of the second carrier-associated recess 30 defines a reduced-width portion 34 for receiving the free end of the carrier 20 in the storage position.

In the closed position (FIG. 1), the carrier 20 is in the storage position received between the first and second carrier-associated recesses, 24 and 30, respectively, and is substantially prevented from movement into the use position. In the open position (FIG. 2), on the other hand, the carrier 20 is movable between the storage and use positions. As shown in FIG. 2, the carrier 20 is fixedly secured to a pivoting support 36 and extends outwardly therefrom, and the pivoting support 36 is fixedly secured to the base 12 and pivotable relative thereto. The base 12 defines a carrier-mounting recess 38 that receives therein the opposite ends of the pivoting support 36 to frictionally engage the pivoting support, yet allow the pivoting support to pivot relative thereto to, in turn, pivot the carrier between the storage and use positions. The pivoting support 36 includes a laterally-extending base 37 that engages and supports thereon the end cap of the outer hole saw 22 of the nested hole saws, and pivot pins 39 (only one shown) extending laterally outwardly therefrom and frictionally received within the carrier-mounting recess 38.

The cover 14 defines a first arbor mount 40, and second arbor mount 42 laterally spaced relative to the first arbor mount. In the illustrated embodiment, each arbor mount is defined by a respective substantially rectangular-shaped recess 44 and 46. Each rectangular-shaped recess is configured to receive therein the shank of a respective arbor (not shown) and to frictionally engage the shank to releasably hold the respective arbor therein in a storage position. Each arbor-mounting recess 44 and 46 opens into a respective arbor body recess 48 and 50 for receiving the respective arbor bodies, and each arbor body recess opens into a respective axially-elongated drill bit recess 49 and 51 for receiving a respective drill bit if attached to the arbor. The cover 14 further defines an axially-elongated, spare drill bit recess 52 laterally spaced adjacent to the recess 49 for releasably receiving and frictionally-engaging therein a spare pilot drill bit or other accessory.

The base 12 defines additional recesses 54 and 56 configured to releasably mount therein additional hole saws or other tools or accessories. As can be seen, the recess 56 is configured to releasably receive therein and frictionally engage a larger diameter hole saw than the recess 54. The base 12 defines a first peripheral closure surface 58 that defines a substantially flat surface extending about the periphery of the base, and the cover 14 defines a second peripheral closure surface 60 that defines a substantially flat surface extending about the periphery of the cover. In the closed position, the first and second peripheral closure surfaces 58 and 60, respectively, contact each other to form a closure. If desired, the peripheral closure surfaces 58 and 60 may form a sealed closure, such as a water-tight seal, to further protect the contents of the kit 10 in the closed position. Two holes 62, 62 are formed through the cover 14 and the base 12 and are aligned with each other when the kit is in the closed position to define a single hole that can be used to receive a clip, strap or other device for hanging or otherwise attaching the kit to another device or article. As shown in FIG. 1, in the closed position, the kit 10 defines a compact configuration and shape facilitating ease of carrying or fitting into a tool kit or other tool-carrying device, such as tool bucket or bag. The side walls of the cover and base define a plurality of laterally spaced ribs 64 to facilitate gripping the kit, and to provide an aesthetically pleasing appearance.

As may be recognized by those of ordinary skill in the pertinent art based on the teachings herein, numerous changes and modifications may be made to the above-described and other embodiments of the present invention.

What is claimed is:

1. A device comprising:

an axially-elongated carrier configured to releasably carry thereon a plurality of nested hole saws and is movable between (i) a storage position and (ii) a use position configured for removing one or more of the plurality of hole saws therefrom;

a first recess defining a plurality of different width recessed portions configured to receive at least part of any hole saws carried on the carrier in the storage position; and a plurality of nested hole saws releasably carried on the carrier and, in the storage position, at least partially received within the first recess.

2. A device as defined in claim 1, wherein in the storage position the carrier is retracted within the device, and in the use position the carrier extends from the device for releasing one or more of the plurality of hole saws therefrom or installing one or more of the plurality of hole saws thereon.

3. A device as defined in claim 2, wherein in the use position the carrier is substantially upright.

4. A device as defined in claim 1, wherein the first recess is further configured to receive at least part of the carrier in the storage position.

5. A device as defined in claim 1, wherein the carrier is received through an arbor hole in each of the plurality of hole saws.

6. A device as defined in claim 5, wherein the carrier is pivotally mounted on the device and pivotable between the storage and use positions.

7. A device as defined in claim 1, wherein each different width recessed portion is configured to releasably hold a diameter of a respective size hole saw and configured to receive at least part of the hole saw of the respective size therein in the storage position.

8. A device as defined in claim 7, wherein the different width recessed portions define successively narrower widths relative to each other.

9. A device as defined in claim 1, further comprising a base and a cover, wherein at least one of the base and the cover is movable relative to the other between an open position and a closed position, wherein in the closed position the carrier is in the storage position and is substantially prevented from movement into the use position, and in the open position the carrier is movable between the storage position and the use position.

10. A device as defined in claim 9, wherein the base defines the first recess, and the cover defines a second recess configured to receive at least one of at least a portion of the carrier and at least a portion of the plurality of hole saws in the storage position.

11. A device as defined in claim 10, wherein at least one of the base and the cover defines at least one of (i) at least one hole saw mount located laterally relative to the carrier and configured to releasably mount at least one additional hole saw; (ii) at least one arbor mount located laterally relative to the carrier and configured to releasably mount an arbor; and (iii) at least one pilot drill mount located laterally relative to the carrier and configured to releasably mount a pilot drill.

12. A device as defined in claim 11, wherein (i) the at least one hole saw mount is defined by a respective hole saw recess located laterally relative to the first or second recess and configured to releasably receive at least a portion of said at least one additional hole saw therein; (ii) the at least one arbor mount is defined by at least one arbor recess located laterally relative to the first or second recess and configured to releasably receive at least a portion of said at least one arbor therein; and (iii) the at least one pilot drill mount is defined by at least one pilot drill recess located laterally relative to the first or second recess and configured to releasably receive at least a portion of said at least one pilot drill therein.

13. A device as defined in claim 11, wherein each mount frictionally engages said respective hole saw, arbor, or pilot drill to releasably retain said respective hole saw, arbor, or pilot drill.

14. A device as defined in claim 9, wherein at least one of the base and the cover defines the first recess and includes at least one of (i) at least one hole saw mount located laterally relative to the first recess and configured to releasably mount at least one additional hole saw; (ii) at least one arbor mount located laterally relative to the first recess and configured to releasably mount an arbor; and (iii) at least one pilot drill mount located laterally relative to the first recess and configured to releasably mount a pilot drill.

15. A device as defined in claim 14, wherein at least one of the base and cover defines at least one additional (i) hole saw mount, (ii) arbor mount, or (iii) pilot drill mount.

16. A device as defined in claim 14, wherein at least one of the base and the cover defines a plurality of said hole saw mount and a plurality of said arbor mount.

17. A device as defined in claim 9, wherein the base and cover are pivotally mounted to each other and pivotable between the open and closed positions.

18. A device for carrying hole saws comprising:

first means for releasably carrying thereon a plurality of nested hole saws;

second means for pivotally moving the first means between (i) a storage position and (ii) a use position configured for removing one or more of the plurality of hole saws therefrom;

a first recess defining a plurality of different width recessed portions configured to receive at least part of any hole saws carried on the first means in the storage position; and a plurality of nested hole saws releasably carried on the first means and, in the storage position, at least partially received within the first recess.

19. A device as defined in claim 18, wherein the first means is an axially-elongated carrier received through an arbor hole in each of the plurality of hole saws, and the second means is a pivot mount configured for pivoting the first means on the device between the storage position and the use position.

* * * * *